US006447926B2

(12) United States Patent
Schmidt-Thümmes et al.

(10) Patent No.: US 6,447,926 B2
(45) Date of Patent: Sep. 10, 2002

(54) PAPER COATING SLIPS BASED ON LOW-CROSSLINK BINDERS

(75) Inventors: Jürgen Schmidt-Thümmes, Neuhofen; Thomas Wirth, Freinsheim; Stefan Kirsch, Heidesheim, all of (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/774,619

(22) Filed: Feb. 1, 2001

(30) Foreign Application Priority Data

Feb. 23, 2000 (DE) ..... 100 08 276

(51) Int. Cl.[7] ..... B32B 23/08; B32B 27/30; B41M 5/00; D21H 19/58

(52) U.S. Cl. ..... 428/514; 428/511; 428/522; 526/318; 526/318.43; 526/325; 526/329.2; 526/329.7; 526/341

(58) Field of Search ..... 428/500, 511, 428/513, 514, 522; 526/318, 318.43, 325, 329.2, 329.7, 341

(56) References Cited

U.S. PATENT DOCUMENTS 4,289,675 A * 9/1981 Krajewski ..... 428/500

FOREIGN PATENT DOCUMENTS

| | | |
|---|---|---|
| CA | 2221479 | 1/1997 |
| WO | WO 97/00776 | 1/1997 |

* cited by examiner

*Primary Examiner*—D. S. Nakarani
(74) *Attorney, Agent, or Firm*—Oblon, Spivak, McClelland, Maier & Neustadt, P.C.

(57) ABSTRACT

The present invention provides paper coating slips comprising a low-crosslink copolymer as their binder.

11 Claims, No Drawings

PAPER COATING SLIPS BASED ON LOW-CROSSLINK BINDERS

DESCRIPTION

The present invention relates to paper coating slips comprising as their binder a copolymer built up from from 45 to 74.8% by weight of at least one monomer whose homopolymer has a glass transition temperature <20° C. (monomers A), from 25 to 54.8% by weight of at least one monomer whose homopolymer has a glass transition temperature >50° C. (monomers B), from 0.001 to 1.0% by weight of at least one crosslinking monomer having at least two nonconjugated vinyl groups (monomers C), and optionally from 0 to 10% by weight of at least one monomer containing acid groups (monomers D), and from 0 to 10% by weight of at least one further monomer (monomers E).

The invention relates additionally to papers coated with said paper coating slips and to a process for printing these papers.

Paper coating slips consist essentially of a polymeric binder and a white pigment. Coating with paper slips gives untreated papers a smooth white surface. Paper coating slips are intended in particular to bring about an improvement in printability.

The binders used in paper coating slips are, conventionally, acrylate or styrene/butadiene copolymers. Paper coating slips of this kind are described, for example, in WO 97/00776.

It is an object of the present invention to provide paper coating slips having improved properties or alternative paper coating slips having a novel raw-material base.

We have found that this object is achieved by paper coating slips comprising as their binder a copolymer built up from from 45 to 74.8% by weight of at least one monomer whose homopolymer has a glass transition temperature <20° C. (monomers A), from 25 to 54.8% by weight of at least one monomer whose homopolymer has a glass transition temperature >50° C. (monomers B), from 0.001 to 1.0% by weight of at least one crosslinking monomer having at least two nonconjugated vinyl groups (monomers C), and optionally from 0 to 10% by weight of at least one monomer containing acid groups (monomers D), and from 0 to 10% by weight of at least one further monomer (monomers E).

By the glass transition temperature ($T_g$) is meant the limiting value approached by the glass transition temperature with increasing molecular weight in accordance with G. Kanig (Kolloid-Zeitschrift & Zeitschrift für Polymere, Vol. 190, page 1, equation 1). The glass transition temperature is determined by the technique of DSC (Differential Scanning Calorimetry, 20 K/min, midpoint measurement, DIN 53765). The $T_g$ values for the homopolymers of the majority of monomers are known and are listed, for example, in Ullmann's Encyclopedia of Industrial Chemistry, VCH Weinheim, 1992, 5th Edition, Vol. A21, p. 169; further sources of glass transition temperatures of homopolymers are, for example, J. Brandrup, E. H. Immergut, Polymer Handbook, 1st Ed., J. Wiley, New York, 1966, 2nd Ed. J.Wiley, New York, 1975, and 3rd Ed. J. Wiley, New York, 1989.

$C_1$ to $C_{10}$ alkyl groups hereinbelow are linear or branched alkyl radicals having 1 to 10 carbon atoms, for example, methyl, ethyl, n-propyl, iso-propyl, n-butyl, sec-butyl, iso-butyl, tert-butyl, n-pentyl, iso-pentyl, tert-pentyl, n-hexyl, 2-ethylhexyl, n-nonyl and n-decyl. $C_5$ to $C_{10}$ cycloalkyl groups are preferably cyclopentyl or cyclohexyl groups, unsubstituted or substituted by 1, 2 or 3 $C_1$ to $C_4$ alkyl groups.

In accordance with the invention, the binder used comprises a copolymer containing in copolymerized form from 45 to 74.8% by weight, preferably from 50 to 65% by weight, based in each case on the copolymer, of at least one monomer A. Accordingly, the copolymer is obtained by polymerizing a monomer mixture comprising said at least one monomer A in an amount of from 45 to 74.8% by weight, preferably from 50 to 65% by weight, based in each case on the overall amount of the monomer mixture. It is noted at this point that the percentage amounts specified in the description for the monomers A to E copolymerized in the copolymer are intended generally to correspond to the amounts of these monomers in the monomer mixture to be polymerized, and vice versa.

Suitable monomers A are preferably vinyl ethers of $C_3$ to $C_{10}$ alkanols, branched and unbranched $C_3$ to $C_{10}$ olefins, $C_1$ to $C_{10}$ alkyl acrylates, $C_5$ to $C_{10}$ alkyl methacrylates, $C_5$ to $C_{10}$ cycloalkyl acrylates and methacrylates, $C_1$ to $C_{10}$ dialkyl maleates and/or $C_1$ to $C_{10}$ dialkyl fumarates. Particular preference is given to those monomers A whose homopolymers have $T_g$ values <0° C. Particularly preferred monomers A are ethyl acrylate, n-propyl acrylate, n-butyl acrylate, iso-butyl acrylate, sec-butyl acrylate, n-hexyl acrylate, 2-ethylhexyl acrylate, n-hexyl methacrylate, 2-ethylhexyl methacrylate, di-n-butyl maleate and/or di-n-butyl fumarate or mixtures thereof.

Suitable monomers B are vinylaromatic monomers, $C_1$ to $C_4$ alkyl methacrylates and/or α,β-unsaturated carbonitriles or dicarbonitriles. They are used in amounts of from 25 to 54.8% by weight and preferably from 35 to 50% by weight, based in each case on the overall amount of the monomer mixture, for the polymerization. Accordingly, the copolymer used in accordance with the invention is built up to the extent of from 25 to 54.8% by weight, and preferably 35 to 50% by weight, of at least one monomer B in copolymerized form. By vinylaromatic monomers are meant in particular derivatives of styrene or of α-methylstyrene in which the phenyl rings are unsubstituted or substituted by 1, 2 or 3 $C_1$ to $C_4$ alkyl groups, chloro and/or methoxy groups. Preference is given to those monomers B whose homopolymers have a glass transition temperature of >80° C. Particularly preferred monomers B are styrene, α-methylstyrene, o- or p-vinyltoluene, methyl methacrylate, acrylonitrile, methacrylonitrile, maleonitrile, fumaronitrile or mixtures thereof.

Said at least one monomer C is used in an amount of from 0.001 to 1% by weight in the monomer mixture, based on its overall amount. Accordingly, the copolymer is built up from 0.001 to 1% by weight of at least one monomer C in copolymerized form. Preferably, the copolymer contains from 0.001 to 0.5% by weight or from 0.001 to 0.1% by weight of copolymerized monomer C. The copolymer frequently contains ≧0.001% by weight, ≧0.002% by weight, ≧0.003% by weight, ≧0.004% by weight, ≧0.005% by weight, ≧0.006% by weight, ≧0.007% by weight, ≧0.008% by weight, ≧0.009% by weight, ≧0.01% by weight, ≧0.02% by weight, ≧0.03% by weight, ≧0.04% by weight, ≧0.05% by weight, ≧0.06% by weight, ≧0.07% by weight, ≧0.08% by weight, ≧0.09% by weight, ≧0.1% by weight, ≧0.2% by weight, ≧0.3% by weight, ≧0.4% by weight, ≧0.5% by weight, ≧0.6% by weight, ≧0.7% by weight, ≧0.8% by weight, ≧0.9% by weight and 1% by weight or <1% by weight, ≦0.9% by weight, ≦0.8% by weight, ≦0.7% by weight, ≦0.6% by weight, ≦0.5% by weight, ≦0.4% by weight, ≦0.3% by weight, ≦0.2% by weight, ≦0.1% by weight, ≦0.09% by weight, ≦0.08% by weight, ≦0.07% by weight, ≦0.06% by weight, ≦0.05% by weight, and all values in between, of at least one monomer C in copolymerized form. Monomers suitable as said at least one monomer C are those having at least two nonconjugated ethylenically unsaturated double bonds. Examples thereof are monomers having two vinyl radicals, monomers having two vinylidene radicals, and monomers having two alkenyl radicals. Particularly advantageous in this context are the diesters of dihydric alcohols with α,β-monoethylenically unsaturated monocarboxylic acids, among which acrylic acid and methacrylic acid are preferred. Examples of such monomers having two nonconjugated ethylenically unsaturated double bonds are alkylene glycol diacrylates and dimethacrylates, such as ethylene glycol diacrylate, 1,2-propylene glycol diacrylate, 1,3-propylene glycol diacrylate, 1,3-butylene glycol diacrylate, 1,4-butylene glycol diacrylates and ethylene glycol dimethacrylate, 1,2-propylene glycol dimethacrylate, 1,3-propylene glycol dimethacrylate, 1,3-butylene glycol dimethacrylate, 1,4-butylene glycol dimethacrylate, and also divinylbenzene, vinyl methacrylate, vinyl acrylate, allyl methacrylate, allyl acrylate, diallyl maleate, diallyl fumarate, methylenebisacrylamide, cyclopentadienyl acrylate, triallyl cyanurate, and triallyl isocyanurate.

The copolymer may optionally be obtained by polymerizing a monomer mixture containing up to 10% by weight or from 0.1 to 7% by weight or from 0.5 to 5% by weight, based in each case on the overall monomer amount, of at least one monomer D. Accordingly, the copolymer may contain in copolymerized form up to 10% by weight or from 0.1 to 7% by weight or from 0.5 to 5% by weight of at least one monomer D. It is advantageous if the copolymer contains in copolymerized form from 1 to 4% by weight of monomer D. The monomers D comprise ethylenically unsaturated monomers which are able to form anionic groups. These groups are preferably carboxylate, phosphonate or sulfonate groups, but especially carboxylate groups. Particularly preferred monomers D are monoethylenically unsaturated alkylsulfonic or arylsulfonic acids, such as vinylsulfonic acid, methallylsulfonic acid, vinylbenzenesulfonic acid, acrylamidoethanesulfonic acid, acrylamido-2-methylpropanesulfonic acid, 2-sulfoethyl acrylate, 2-sulfoethyl methacrylate, 3-sulfopropyl acrylate, 3-sulfopropyl methacrylate, and also α,β-ethylenically unsaturated $C_3$ to $C_6$ carboxylic acids, α,β-ethylenically unsaturated $C_4$ to $C_8$ dicarboxylic acids or their anhydrides, such as acrylic acid, methacrylic acid, crotonic acid, fumaric acid, maleic acid, maleic anhydride, itaconic acid and itaconic anhydride, and also the alkali metal salts or ammonium salts of said monomers, especially their sodium salts.

The monomer mixture may optionally likewise contain up to 10% by weight, based on its overall amount, of at least one monomer E. Accordingly, the copolymer optionally contains in copolymerized form up to 10% by weight of at least one monomer E. The amount of monomer E copolymerized in the copolymer may alternatively be from 0.1 to 8% by weight, from 0.2 to 4% by weight, or else from 0.5 to 2% by weight or from 0.5 to 1.5% by weight. Suitable monomers E are monomers having conjugated vinyl groups, such as 1,3-butadiene or isoprene, for example, and also free-radically polymerizable monomers having at least one epoxy group, such as glycidyl acrylate and glycidyl methacrylate, for example, N-alkylol group, such as N-methylolacrylamide and N-methylolmethacrylamide, for example, N-alkyloxy group, such as N-(methoxymethyl) acrylamide and N-(methoxymethyl)methacrylamide for example, and also diacetoneacrylamide, 2-(1-aziridinyl) ethyl methacrylate and, furthermore, amides of α,β-ethylenically unsaturated $C_3$ to $C_6$ carboxylic acids, n-hydroxy-$C_2$–$C_6$alkyl esters of α,β-ethylenically unsaturated $C_3$ to $C_6$ carboxylic acids and/or N-vinyllactams, such as, for example, methacrylic and acrylic $C_1$–$C_6$ hydroxyalkyl esters, such as 2-hydroxyethyl, 3-hydroxypropyl or 4-hydroxybutyl acrylate and methacrylate, and also acrylamide and methacrylamide. Further suitable monomers E are monomers having $SiR^1R^2R^3$ groups, where $R^1$, $R^2$ and $R^3$ independently of one another are $C_1$ to $C_4$ alkyl or alkoxy groups, such as vinyltrialkoxysilanes, for example, vinyltrimethoxysilane, vinyltriethoxysilane, or acryloyloxy- and methacryloyloxysilanes, for example, γ-methacryloyloxypropyltrimethoxysilane and β-methacryloyloxyethyltrimethylsilane. Preferably, the copolymer contains no monomer E in copolymerized form.

The monomers may be polymerized, preferably, free-radically or, where possible, also anionically or cationically. Both free-radical and ionic polymerization are known to the skilled worker as customary polymerization methods.

Free-radical polymerization may be conducted, for example, in solution, for example, in water or an organic solvent (solution polymerization), in aqueous dispersion (emulsion polymerization or suspension polymerization), or in bulk, i.e., substantially in the absence of water or organic solvents (bulk polymerization).

The copolymer used in accordance with the invention is advantageously prepared by means of free-radically initiated aqueous emulsion polymerization.

The free-radically initiated aqueous emulsion polymerization may be conducted, for example, batchwise, with or without the use of seed latices, with the inclusion of all or certain constituents of the reaction mixture in the initial charge, or semicontinuously, preferably with the inclusion of some of the constituents or of certain constituents of the reaction mixture in the initial charge and the subsequent metered addition of the remainder, or by the metering technique without an initial charge. It is also possible for the polymerization to be conducted in stages, with differences in the monomer composition of the individual stages.

In the free-radically initiated aqueous emulsion polymerization the monomers may be polymerized, conventionally, in the presence of a water-soluble initiator and of an emulsifier.

Examples of suitable initiators are sodium, potassium and ammonium peroxodisulfates, tert-butyl hydroperoxide, water-soluble azo compounds, such as 2,2'-azobis (isobutyronitrile), 2,2'-azobis(2,4-dimethylvaleronitrile) and 2,2'-azobis(amidinopropyl)dihydrochloride, for example, or else redox initiators, such as hydrogen peroxide/ascorbic acid, for example. The initiators are frequently used in amounts of from 0.1 to 3% by weight, based on the overall amount of the monomers A to E.

Examples of suitable emulsifiers are alkali metal salts of relatively long-chain fatty acids, alkyl sulfates, alkylsulfonates, alkylated arylsulfonates or alkylated bisphenyl ether sulfonates. Further suitable emulsifiers include reaction products of alkylene oxides, especially ethylene oxide and/or propylene oxide, with fatty alcohols or fatty acids or phenols, and/or alkylphenols, and sulfated derivatives thereof. Emulsifiers are frequently used in amounts of up to 5% by weight, based on the overall amount of the monomers A to E.

In addition to or instead of emulsifiers it is also possible to use natural and/or synthetic protective colloids, such as starch, casein, gelatin, alginates, hydroxycellulose, methylcellulose, carboxymethylcellulose or polyvinyl alcohols, for example.

In the case of aqueous secondary dispersions, the copolymer is first prepared by solution polymerization in an organic solvent and then the solution polymer is dispersed in water, with or without emulsifier. The organic solvent may then be removed by distillation. The preparation of aqueous secondary dispersions is known to the skilled worker and is described, for example, in DE-A 37 20 860.

To adjust the molecular weight of the copolymers it is possible during the polymerization to use compounds known as regulators in amounts of up to 2% by weight, based on the overall amount of the monomers A to E used for the polymerization. Examples of suitable compounds are those containing thiol groups, such as mercaptoethanol, mercaptopropanol, thioglycerol, ethyl thioglycolate, methyl thioglycolate and tert-dodecylmercaptan, for example, and also trichlorobromomethane and allyl alcohols.

The pressure and temperature of the polymerization are of minor importance. In general it is conducted at temperatures between 20 and 200° C., preferably at temperatures from 50 to 120° C., and with particular preference between 60 and 90° C. Advantageously, the free-radically initiated aqueous emulsion polymerization is conducted at atmospheric pressure (1 bar absolute) under an inert gas atmosphere, such as under nitrogen or argon, for example.

Following the polymerization reaction proper it is generally necessary to remove odorous substances, such as residual monomers and other volatile organic constituents, from the aqueous polymer dispersion used in accordance with the invention. This can be done conventionally by physical means, by distillative removal (in particular by way of steam distillation) or by stripping with an inert gas. Furthermore, the amount of residual monomers may be reduced chemically, by free-radical postpolymerization, especially under the action of redox initiator systems, as set out, for example, in DE-A 44 35 423, DE-A 44 19 518, and DE-A 44 35 422, before, during or after the distillative treatment. Especially suitable oxidizing agents for redox-initiated postpolymerization are hydrogen peroxide, tert-butyl hydroperoxide, cumene hydroperoxide, and alkali metal peroxodisulfates. Suitable reducing agents are sodium disulfite, sodium hydrogen sulfite, sodium dithionite, sodium hydroxymethanesulfinate, formamidinesulfinic acid, acetone bisulfite (i.e., the adduct of sodium hydrogen sulfite with acetone), ascorbic acid, and sugar compounds having a reducing action. The postpolymerization with the redox initiator system is conducted in the temperature range from 10 to 100° C., preferably at from 20 to 90° C. The redox partners may independently of one another be added to the aqueous polymer dispersion completely, in portions, and/or continuously over a period of from 10 minutes to 4 hours. To improve the postpolymerization effect of the redox initiator systems, soluble salts of metals of changing valence, such as iron, copper, or vanadium salts, may also be added to the dispersion. In many cases, complexing agents are added as well, which keep the metal salts in solution under the reaction conditions.

Moreover, the aqueous copolymer dispersions may comprise customary auxiliaries, such as alkali metal hydroxide, ammonia or ethanolamine as neutralizing agents, silicone compounds as defoamers, biozides and also silicone oils or waxes for reducing the tack.

The solids content of the aqueous copolymer dispersion obtained is preferably from 30 to 80% by weight, with particular preference from 45 to 75% by weight.

The number-average diameter of the polymer particles present in the aqueous polymer dispersions, as determined by way of quasielastic light scattering (ISO Standard 13 321), is preferably in the range from 50 to 300 nm, with particular preference in the range from 100 to 200 nm. The polymer particles generally have a monomodal size distribution.

The solution polymerization may be conducted continuously, batchwise or, preferably, semicontinuously by the feed technique. In the latter case, a portion of the monomers A to E may be included in the initial charge to the polymerization vessel, after which this initial charge is heated to the polymerization temperature and the remainder of the monomers are supplied continuously.

Examples of solvents that may be used for the free-radical solution polymerization are water, alcohols, such as isopropanol or iso-butanol, for example, aromatics, such as toluene or xylene, for example, ethers, such as tetrahydrofuran or dioxane, for example, ketones, such as acetone or cyclohexanone, for example, and esters, such as ethyl acetate or n-butyl acetate, for example.

Preferred initiators include dibenzoyl peroxide, tert-butyl perpivalate, tert-butyl 2-ethylhexanoate, tert-amyl 2-ethylhexyl peroxide, di-tert-butyl peroxide, cumene hydroperoxide, dilauroyl peroxide, didecanoyl peroxide, methyl ethyl ketone peroxide, 2,2'-azobis(isobutyronitrile), 2,2'-azobis(2,4-dimethylvaleronitrile), and 2,2'-azobis(2,3-dimethylbutyronitrile).

In the case of the bulk polymerization, a portion of the polymerization batch comprising monomers and free-radical initiators is generally included in the initial charge, which is heated to the polymerization temperature, and then the remainder is supplied continuously.

Preferably, however, the copolymer is prepared by a free-radically initiated aqueous emulsion polymerization and is used in the form of its aqueous copolymer dispersion.

The glass transition temperature of the copolymer is usually from −40 to +50° C., preferably from 0 to +30° C., and with particular preference from +5 to +15° C.

The paper coating slips comprise the copolymer as binder preferably in amounts of from 1 to 50% by weight, in particular from 5 to 20% by weight, based on the pigment amount (solids/solids).

Normally, the pigments constitute the principal component of the paper coating slips. Frequently used pigments are, for example, natural or precipitated calcium carbonate, kaolin, calcined or aggregated clay, talc, gypsum, titanium dioxide, zinc oxide, barium sulfate, and satin white. Polymer pigments may also be used together with one or more of these inorganic pigments.

Furthermore, the paper coating slips may comprise customary dispersants. Examples of suitable dispersants are polyanions, for example, of polyphosphoric acids or of polyacrylic acids (poly salts), which are present usually in amounts of from 0.1 to 3% by weight, based on the pigment amount.

The paper coating slips may further include what are known as cobinders. Natural cobinders that may be mentioned include starch, casein, gelatin and alginates, hydroxyethylcellulose, methylcellulose and carboxymethylcellulose as modified natural products, and also cationically modified starch. Alternatively, use may be made of customary synthetic cobinders, based for example on vinyl acetate or on acrylate. The amount of cobinder is usually from 0.1 to 10% by weight, based on the pigment amount.

To prepare the paper coating slips, the constituents are mixed in a known way, the copolymer generally being used in the form of an aqueous dispersion.

The water content of the paper coating slip is usually adjusted to from 40 to 75% by weight, based on the solids of the paper coating slip.

The paper coating slip may be applied to the paper substrates by customary methods (cf. Ullmann's Encyclopädie der Technischen Chemie, VCH Weinheim, 1979, 4th Edition, Vol. 17, pages 603 to 609).

Suitable substrate papers are papers of a very wide variety of thicknesses, including cardboard and the like.

The papers are preferably coated at from 2 to 50 g/m$^2$ with the paper coating slip (calculated on a dry basis).

The papers coated with the paper coating slips of the invention exhibit good printability. The papers are especially suitable for offset, gravure or flexographic printing processes.

EXAMPLES

Analysis

The number-average diameter of the polymer particles was determined by means of dynamic light scattering on a from 0.005 to 0.01 percent by weight aqueous dispersion at 23° C. by means of an Autosizer IIC from Malvern Instruments, England. The value reported is the average diameter of the cumulant evaluation (cumulant z-average) of the measured autocorrelation function (ISO Standard 13 321).

The solids contents were determined by drying an aliquot in a drying oven at 140° C. for 6 hours. Two separate measurements were conducted in each case. The value reported in the respective examples represents the mean of the two measured results.

1. Synthesis of the Copolymers by Free-radically Initiated Aqueous Emulsion Polymerization General preparation procedure for Examples 1 to 7 and the Comparative Example.

A 4 1 polymerization vessel with stirrer and reflux condenser was charged with 498 g of deionized water, 40 g of an aqueous polystyrene seed latex (polymer solids content 33% by weight, number-average particle diameter 30 nm), and 90 g of feed stream I and this initial charge was heated to 70° C. under a nitrogen atmosphere, with stirring. After an internal temperature of 60° C. had been reached, 9 g of feed stream II were added. When an internal temperature of 70° C. had been reached, the remainders of feed stream I and feed stream II were metered continuously over the course of 2 hours, beginning simultaneously, into the polymerization batch via two separate feed ports, this addition taking place with stirring and with retention of the reaction temperature. After the end of both feed streams, reaction was allowed to continue at reaction temperature for 15 minutes. Subsequently, 24 g of a 10% strength by weight aqueous solution of tert-butyl hydroperoxide and 34 g of a 12% strength by weight aqueous solution of acetone bisulfite (i.e., the adduct of sodium hydrogen sulfite with acetone) were metered in continuously over the course of 2 hours, beginning simultaneously, via two separate feed ports. Subsequently, the reaction mixture was cooled to room temperature, adjusted to a pH of 8.4 using a 10% strength by weight aqueous solution of ammonia, and filtered through a metal filter having a mesh size of 250 $\mu$m. A compilation of the process parameters, and the characterization of the resultant copolymers in terms of solids content, SC, and number-average particle diameter, $D_n$, is given in Table 1.

Feed stream I:

448 g of deionized water 40 g of a 15% strength by weight aqueous solution of sodium lauryl sulfate 18.7 g of a 45% strength by weight aqueous solution of Dowfax®2A1 (trademark of Dow Chemical Company)

660 g of n-butyl acrylate (monomer A)

504 g of styrene (monomer B)

x g of monomer C 36 g of acrylic acid (monomer D)

Feed stream II:

4.7 g of sodium peroxodisulfate 62.2 g of deionized water

TABLE 1

Summary of Examples 1 to 7 and the Comparative Example

| Example | Monomer C | Amount x [g] | SC [% by wt.] | $D_n$ [nm] |
|---|---|---|---|---|
| Comparative | — | — | 51.4 | 145 |
| 1 | 1,4-butanediol diacrylate | 0.2 | 51.0 | 150 |
| 2 | 1,4-butanediol diacrylate | 0.4 | 50.8 | 146 |
| 3 | 1,4-butanediol diacrylate | 0.6 | 50.6 | 147 |
| 4 | 1,4-butanediol diacrylate | 1.4 | 50.6 | 145 |
| 5 | 1,4-butanediol dimethacrylate | 0.4 | 50.5 | 146 |
| 6 | Ethylene glycol dimethacrylate | 0.4 | 50.4 | 148 |
| 7 | 1,4-divinyl-benzene | 0.4 | 50.7 | 141 |

2. General Procedure for Preparing the Paper Coating Slips of the Invention

The paper coating slips of the invention were prepared by blending the components indicated in Table 2, in the order specified therein, using a dissolver. The varying solids content of the copolymer dispersions used was taken into account in terms of the amount employed and was such that the formulation contained 10 parts by weight of copolymer (solids, based on 100 parts by weight of the sum of the inorganic pigments). The pH of the paper coating slips was adjusted to 8.5–9 using a 10% strength by weight solution of sodium hydroxide. Subsequently, the solids content of the paper coating slip was adjusted to 68% by weight by adding deionized water.

TABLE 2

Formulation of the paper coating slips of the invention

| Parts by weight | Component |
|---|---|
| | Portion of the deionized water |
| 0.4 | Polysodium salt of a polyacrylic acid having a molecular weight of 4000 (Polysalz from BASF AG) |
| 0.5 | Carboxymethylcellulose |
| 70 | Finely divided chalk |
| 30 | Finely divided clay |
| 10 | Copolymer (calculated as solids) |
| | pH adjustment with 10% strength by weight sodium hydroxide solution |
| | Remainder of the deionized water to adjust the solids content to 68% by weight |

3. General Procedure for Paper Coating

The base paper used was a chemical coating base paper having a basis weight of 70 g/m$^2$. The slip was applied to both sides at 10 g/m$^2$ per side (calculated as solids) on a laboratory coating machine (application technique: roller, metering technique: blade).

The paper webs were dried using an IR drying unit and air drying (8 IR dryers at 650 Watts each, transit speed 30 m/min).

Test strips measuring 35 cm×20 cm were cut from the coated paper webs. The test strips were subsequently stored for 17 hours at 23° C. and a relative atmospheric humidity of 50% (DIN 50014-23/50-2). Thereafter, the test strips were calendered at a temperature of 25° C. using the laboratory bench calender K8/2 from Kleinewefers, Krefeld, Germany. The linear pressure between the rollers was 200 kN/cm paper width and the speed was 10 m/min. the procedure was repeated four times.

4. Performance Tests a) Determination of dry pick resistance using the IGT sample print apparatus (IGT dry)

The test strips were printed by the offset process at increasing speeds. The maximum printing speed was 200 cm/s. The ink was applied at a linear pressure of 350 N/cm.

Using the so-called point evaluation, the tenth pick from the first pick (i.e., the first point at which tearing occurs from the paper coating slip) is counted.

The dry pick resistance is reported in cm/s, i.e., the printing speed obtaining at the tenth pick. The higher this printing speed at the tenth pick, the better the evaluation of the copolymer's suitability as a binder in paper coating slips.

b) Pick resistance on multiple printing (offset test)

The test strips were printed at a constant speed of 1 m/s with a linear pressure of 200 N/cm.

The printing operation was repeated after 30 seconds. The reported pick resistance is the number of passes until picking occurs. The higher the number of passes (printing operations) before the first pick, the better the evaluation of the copolymer's suitability as a binder in paper coating slips.

TABLE 3

Results of the performance tests

| Example | Monomer C | Amount × [g] | IGT dry [cm/s] | Offset test [number] |
|---|---|---|---|---|
| Comparative | — | — | 53 | 2 |
| 1 | 1,4-Butanediol diacrylate | 0.2 | 64 | 3 |
| 2 | 1,4-Butanediol diacrylate | 0.4 | 68 | 3 |
| 3 | 1,4-Butanediol diacrylate | 0.6 | 74 | 4 |
| 4 | 1,4-Butanediol diacrylate | 1.4 | 65 | 3 |
| 5 | 1,4-Butanediol dimethacrylate | 0.4 | 68 | 3 |
| 6 | Ethylene glycol dimethacrylate | 0.4 | 62 | 3 |
| 7 | 1,4-divinylbenzene | 0.4 | 64 | 3 |

As evident from the results in Table 3, even small amounts of monomers C lead to a marked improvement in the dry pick resistance and in the pick resistance on multiple printing.

We claim:

1. A paper coating slip, comprising:

a copolymer as a binder for said coating slip;

said copolymer obtained by copolymerizing a mixture of from 45 to 74.8% by weight of at least one monomer A whose homopolymer has a glass transition temperature <20° C., from 25 to 54.8% by weight of at least one monomer B whose homopolymer has a glass transition temperature >50° C., from 0.001 to 1.0% by weight of at least one crosslinking monomer C having at least two nonconjugated vinyl groups, from 0 to 10% by weight of at least one monomer D containing an acid group, and from 0 to 10% by weight of at least one further monomer E.

2. The paper coating slip as claimed in claim 1, wherein said monomer A is selected from the group of $C_1$ to $C_{10}$ alkyl acrylate, $C_5$ to $C_{10}$ alkyl methacrylate, $C_5$ to $C_{10}$ cycloalkyl acrylate, $C_5$ to $C_{10}$ cycloalkyl methacrylate, $C_1$ to $C_{10}$ dialkyl maleate, $C_1$ to $C_{10}$ dialkyl fumarate, and a mixture of $C_1$ to $C_{10}$ dialkyl maleate and $C_1$ to $C_{10}$ dialkyl fumarate; and wherein said monomer B is selected from the group consisting of a vinylaromatic monomer, a $C_1$ to $C_4$ alkyl methacrylate, an α,β-unsaturated carbonitrile, an α,β-unsaturated dicarbonitrile, a mixture of a $C_1$ to $C_4$ alkyl methacrylate and an α,β-unsaturated carbonitrile, and a mixture of a $C_1$ to $C_4$ alkyl methacrylate and an α,β-unsaturated dicarbonitrile.

3. The paper coating slip as claimed in claim 1, wherein said copolymer contains in copolymerized form from 0.001 to 0.5% by weight of at least one monomer C.

4. The paper coating slip as claimed in claim 1, wherein said copolymer contains in copolymerized form from 0.001 to 0.1% by weight of at least one monomer C.

5. The paper coating slip as claimed in claim 1, wherein said copolymer contains in copolymerized form from 0.5 to 5% by weight of at least one monomer D.

6. The paper coating slip as claimed in claim 1, wherein said copolymer consists of particles having an number-average diameter of from 50 to 300 nm.

7. The paper coating slip as claimed in claim 1, wherein said copolymer has a glass transition temperature of from −40 to +50° C.

8. A paper coated with the paper coating slip as claimed in claim 1.

9. A process for printing paper, comprises:

contacting the paper as claimed in claim 8 with an ink.

10. The process as claimed in claim 9, which is an offset, gravure or flexographic printing process.

11. The paper coating slip as claimed in claim 1, wherein said copolymer contains in copolymerized form from 0.001 to 0.116% by weight of at least one monomer C.

* * * * *